US005167374A

United States Patent [19]

Strohmeyer

[11] Patent Number: 5,167,374

[45] Date of Patent: Dec. 1, 1992

[54] PAPER SHREDDER WITH SWITCH-OFF RETARDATION

[75] Inventor: Willi Strohmeyer, Hanover, Fed. Rep. of Germany

[73] Assignee: Geha-Werke GmbH, Hannover, Fed. Rep. of Germany

[21] Appl. No.: 833,858

[22] Filed: Feb. 7, 1992

[30] Foreign Application Priority Data

Feb. 9, 1991 [DE] Fed. Rep. of Germany ..... 4103950

[51] Int. Cl.[5] ..... B02C 23/00

[52] U.S. Cl. ..... 241/36; 241/100; 241/236; 271/258; 271/265

[58] Field of Search ..... 241/36, 100, 236; 271/258, 265

[56] References Cited

U.S. PATENT DOCUMENTS 3,888,478 6/1975 Alderman, Jr. et al. ..... 271/258 X
4,643,415 2/1987 Kuehnert ..... 271/265 X
4,815,669 3/1989 Fuji ..... 244/236 X
4,817,877 4/1989 Itoh et al. ..... 241/236 X
5,039,020 8/1991 Leuthold et al. ..... 241/100 X
5,042,790 8/1991 Miller et al. ..... 271/258 X

FOREIGN PATENT DOCUMENTS 2045280 3/1972 Fed. Rep. of Germany .
1039601 1/1950 France .
282483 12/1927 United Kingdom .

*Primary Examiner*—Mark Rosenbaum
*Assistant Examiner*—Frances Chin
*Attorney, Agent, or Firm*—Herbert Dubno

[57] ABSTRACT

A piston-and-cylinder retarder delays the switch opening of a switch actuated by a sensor in the path of paper introduced through the paper-feed shaft or chute of a paper shredder, thereby eliminating the need for more expensive and complex electronic time-delay systems to ensure that the shredding unit remains switched on until the trailing edge of the paper passes it.

11 Claims, 2 Drawing Sheets

PAPER SHREDDER WITH SWITCH-OFF RETARDATION

FIELD OF THE INVENTION

Figure 1:
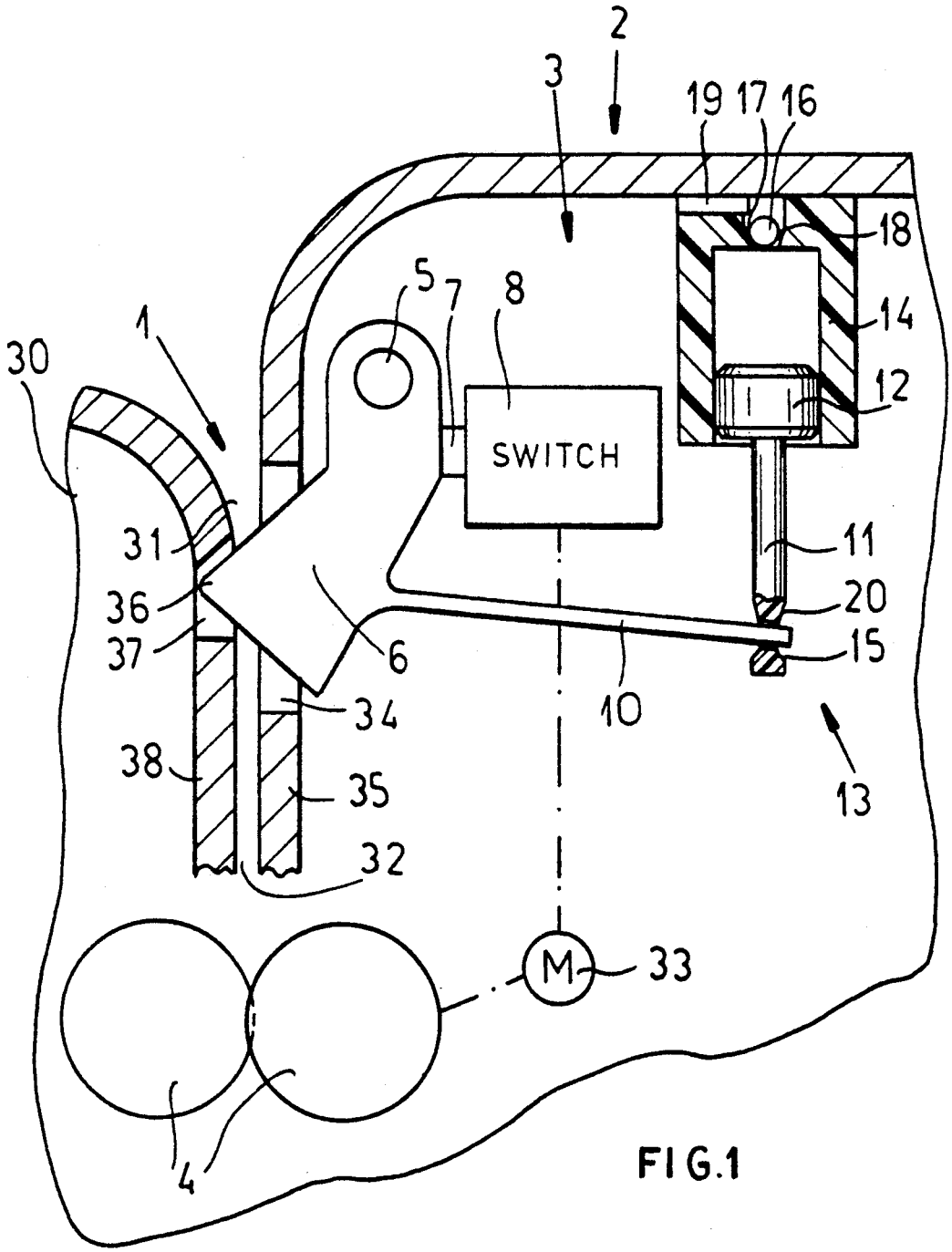

My present invention relates to a paper shredder of the type in which the paper is fed through a paper-feed shaft and actuates a sensor connected to a switch for turning on and off the shredding blades and which is provided with a retarder for delaying the switch off of the cutting unit after the paper clears the sensor.

BACKGROUND O THE INVENTION

Paper shredders of the above-described type have the advantage over paper shredders without a cut-off delay, that when the paper clears the sensor, the shredding means or communicator continues to operate so that residual portions of the paper will not remain readable. In paper shredders without such a shut-off retarder, immediately upon clearing the sensor, the communicator is cut off, thereby leaving a portion of the paper to be comminuted so that it can be read.

In the past, the apparatus has utilized electronic means, such as a time-delay switch which remains in the closed state even after the sensor has been cleared by the trailing edge of the paper to ensure that the paper will be comminuted up to the trailing edge. The problem with such systems is that delayed-opening switches and time-delay circuitry are expensive, are not always reliable and require relatively frequent maintenance and replacement.

OBJECTS OF THE INVENTION

It is the principal object of the present invention to provide an improved paper shredder of the afore-described type which is less expensive and more reliable than the earlier systems.

Another object of this invention is to provide an improved paper shredder which is free from drawbacks of earlier apparatus of this type.

SUMMARY OF THE INVENTION

These objects and others which will become apparent hereinafter are attained, in accordance with the invention, in a paper shredder which comprises:

a housing;

means in the housing forming a paper-feed shaft for paper to be shredded and having a mouth into which paper to be shredded is insertable and an outlet end;

shredding means in the housing juxtaposed with the outlet end of the shaft for comminuting paper discharged through the outlet end;

a switch in the housing electrically connected to the shredding means for turning the shredding means on and off;

a paper sensor positioned along the shaft and actuatable by the insertion of paper into the shaft, the paper sensor being operatively connected to the switch for actuating same; and a switch-off retarder operatively connected to the sensor for delaying turn-off of the shredding means after the sensor is disengaged by paper traversing the shaft, the retarder comprising a cylinder in the housing formed with a venting valve and means forming an air-bleed inlet, and a piston reciprocatable in the cylinder and so connected to the sensor that actuation of the sensor by insertion of paper into the shaft displaces the piston in the cylinder from a starting position and discharges air through the valve, the piston returning slowly to the starting position upon bleeding of air into the cylinder through the air-bleed inlet, thereby enabling the sensor to operate the switch to turn off the shredding means.

According to the invention, therefore, the retarder which delays the switching off of the shredder means, i.e. the motor driving the cutting blades, has a cylinder with a venting valve and a blade opening or orifice and whose movable piston is connected with the sensor. With the relatively simple mechanical means or mechanism thus formed, I am able to obtain a highly reliable delay of the cut-off of the shredding device through mechanical control of the return of the sensor into its starting position.

The parts of this mechanism, for example, the cylinder, the piston and the coupling between the sensor and the piston can be formed preferably as injection-molded parts in a highly economical manner.

A surprising advantage of the invention is that, with the usual tolerances in injection-molded articles, a highly precise, reproducible retardation of the cut-off can be obtained.

According to a feature of the invention, the sensor is a lever, for example, a bell-crank lever, one arm of which extends into the path of paper traveling the shaft while another lever arm is articulated to a piston rod of the piston which is displaceable in the cylinder. With this embodiment, a very simple and robust configuration of the mechanism is obtained.

According to another feature of the invention, the cylinder is oriented so as to be vertical in the housing of the shredding machine so that the piston will move by gravity, i.e. under its own weight and the weight of the parts connected thereto, downwardly into the starting position. This arrangement eliminates the need for compression springs or the like to return the piston to the starting position.

Another advantage of this feature of the invention is that it allows the mechanism to be fabricated at a minimum of cost and reduction in the number of parts.

It has been found to be advantageous to form the inlet opening or orifice as an inlet nozzle and to provide this nozzle in the cylinder at the seat of the venting valve. The insertion of a nozzle in the injection-molded cylinder allows an especially exact metering of the air into the cylinder and thus highly precise control of the downward movement of the piston.

BRIEF DESCRIPTION O THE DRAWING

Figure 2:
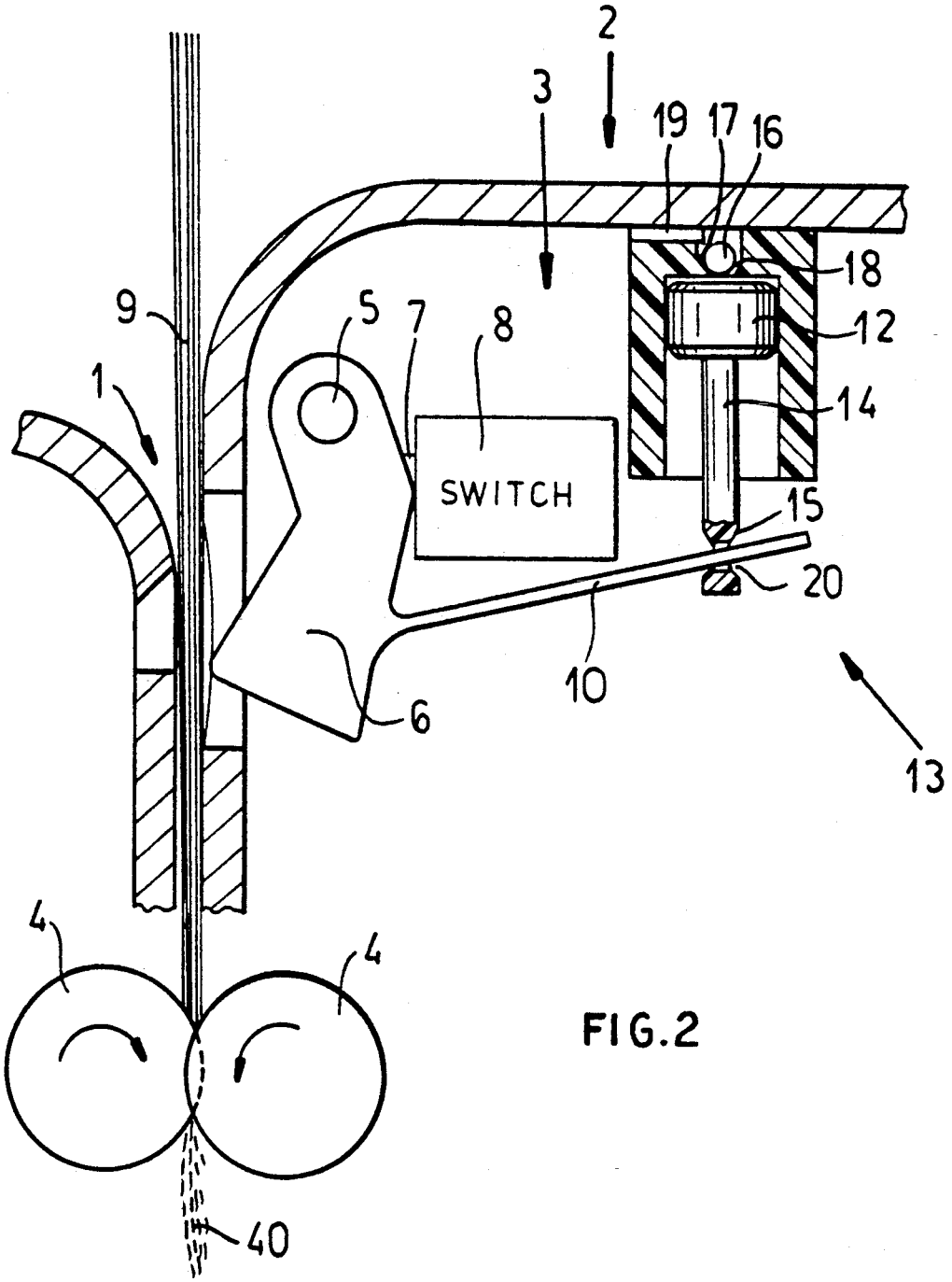

The above and other objects, features and advantages of the present invention will become more readily apparent from the following description, reference being made to the accompanying drawing in which:

FIG. 1 is a vertical section through a portion of a paper shredder according to the invention showing the sensor in the switched-off position of the shredding blades; and FIG. 2 is a similar view of the machine showing the sensor in the switched-on position.

SPECIFIC DESCRIPTION

The drawing shows the paper shredder of the invention in the region of the paper-feed shaft 1, the shredder having a housing 30 defining the shaft 1 which has a mouth 31 into which the paper can be inserted and a discharge end 32 juxtaposed with the shredding blades or rollers 4 which are driven by a motor 33 representing a conventional drive for the shredding means not shown in any detail. The interior of the housing is represented at 3 in FIGS. 1 and 2.

Along the shaft 1, a sensor 6 is provided and can pass through a window 34 in one wall 35 of the shaft so that one arm 36 of the sensor 6 can enter a recess 37 in the other wall 38.

The sensor 6 is shown in its rest position in FIG. 1 extending across the shaft so that it can be displaced in a counterclockwise sense by paper 9 inserted into the shaft. The sensor 6 is a pivotable lever swingable about an axis formed by the pin 5 in the housing.

The lever 6 acts upon the operating element 7 of an electric switch 8 mounted in the housing and a so-called sensitive switch or microswitch controlling motor 33 driving the cutters 4 as previously described.

As soon as paper 9 is inserted into the shaft, the sensor 6 swings to the right in the counterclockwise sense, thereby operating the switch 8 to close the latter and drive the shredding cylinders 4. The switched-on position of the lever 6 and the switch 8 is represented in FIG. 2 and the shredded paper can be seen at 40 in FIG. 2.

The lever 6 has a lever arm 10 which is articulated to a piston rod 11 of a piston 12 of the retarder. The retarding device 13 as a vertically oriented cylinder 14 in which the piston 12 is for the arm 10 formed by a cavity 20 into which the ar 10 extends and which is flanked by inclined walls 15 to allow the relative swinging motion of the arm and the piston rod.

At its upper side, the cylinder 14 is equipped with a vent valve 16, e.g. a check valve, which rests by gravity upon a seat 17. The seat 17 is formed with an inlet nozzle 18. The vent valve 16 is connected by a passage 19 with the ambient atmosphere As can be seen from FIG. 2, as long as paper 9 is present in the shaft, the sensor 6 is held in its right-hand position about the axis 5 to maintain the switch 8 closed and the shredding means 4 turned on. The paper is comminuted and any information thereon is destroyed.

The swinging of the lever 6 by the paper 9 in the counterclockwise sense displaces the piston 12 upwardly via the lever arm 10 and the piston rod 11, in the cylinder 14, driving the air above the piston out through the valve 16 which is moved upwardly so that the air can escape through the passage 19. The retarder mechanism 13 remains in this position as long as the sensor 6 is held by the paper 9 in the position shown in FIG. 2.

As soon as the trailing edge of the paper 9 passes the sensor 6 and the sensor 6 is released, the weight of the piston 12, the rod 11, the lever arm 10 and the swingable parts of the sensor 6 are effective gravitationally to cause the piston to drop at a rate determined by the rate at which air bleeds into the cylinder 14 through the nozzle 18 in the seat 17 of the valve 16.

As a consequence, the lever 6 swings gradually in a clockwise sense, i.e. to the left, until ultimately the switch 8 opens.

The shredding means 4 remains switched on, therefore, until the sensor 6 has reached the starting position, namely, the position shown in FIG. 1 and only then can the actuator 7 of the switch 8 reach its initial position in which the switch 8 open-circuits the motor 33

By corresponding dimensioning of the inlet nozzle 18, the rate at which air is bled into the cylinder can be so limited that the movement of the piston 12 and of the actuator 6 to the rest position is slow enough that the shredding unit 4 remains operational until the trailing edge of the paper has reliably passed the shredding unit 4. The requisite retardation time is dependent upon the rate at which the paper is drawn through the machine and the distance between the shredder unit 4 and the sensor 6.

It has been found to be possible to omit the inlet nozzle 18 at the seat 17 of the valve 16 if there is sufficient leakage between the piston 12 and the inner wall of the cylinder 14 to allow air to bleed into the cylinder. Surprisingly, even in this embodiment, the requisite retardation time can be provided with sufficient accuracy. This construction is especially simple. Of course, if another orientation of the cylinder is desirable, in which the weight of the piston cannot be exploited to bring the system into its starting position, a spring force or the like can be used.

I claim:

1. A paper shredder, comprising:

a housing;

means in said housing forming a paper-feed shaft for paper to be shredded and having a mouth into which paper to be shredded is insertable and an outlet end;

shredding means in said housing juxtaposed with said outlet end of said shaft for comminuting paper discharged through said outlet end;

a switch in said housing electrically connected to said shredding means for turning said shredding means on and off;

a paper sensor positioned along said shaft and actuatable by the insertion of paper into said shaft, said paper sensor being operatively connected to said switch for actuating same; and a switch-off retarder operatively connected to said sensor for delaying turn-off of said shredding means after said sensor is disengaged by paper traversing said shaft, said retarder comprising a cylinder in said housing formed with a venting valve and means forming an air-bleed inlet, and a piston reciprocatable in said cylinder and so connected to said sensor that actuation of said sensor by insertion of paper into said shaft displaces said piston in said cylinder from a starting position and discharges air through said valve, said piston returning slowly to said starting position upon bleeding of air into said cylinder through said air-bleed inlet, thereby enabling said sensor to operate said switch to turn off said shredding means.

2. The paper shredder defined in claim 1 wherein said sensor is a lever swingably mounted in said housing on a pivot axis and having an arm articulated to a piston rod of said piston, said air-bleed inlet being an orifice in said cylinder.

3. The paper shredder defined in claim wherein cylinder is oriented in said housing generally vertically and said piston drops into said starting position at least in weight of the piston, said rod and the arm articulated thereto.

4. The paper shredder defined in claim 3 wherein said orifice is an inlet nozzle.

5. The paper shredder defined in claim 4 wherein said valve has a valve seat, said nozzle being formed at said seat.

6. The paper shredder defined in claim 5 wherein said piston is constructed and arranged to drop into said starting position exclusively by gravitational force thereon.

7. The paper shredder defined in claim wherein said cylinder is oriented in said housing generally vertically and said piston drops into said starting position at least in part under the weight of the piston, a piston rod and an arm articulated thereto.

8. The paper shredder define din claim 7 wherein said air-bleed inlet is an inlet nozzle.

9. The paper shredder defined in claim 8 wherein aid valve has a valve seat, said nozzle being formed at aid seat.

10. The paper shredder defined in claim 9 wherein aid piston is constructed and arranged to drop into said starting position exclusively by gravitational force thereon.

11. The paper shredder defined in claim 1 wherein said valve has a valve seat, said air-bleed inlet being an orifice formed at said seat.

* * * * *